US005816721A

United States Patent [19]

Palmer et al.

[11] Patent Number: 5,816,721

[45] Date of Patent: Oct. 6, 1998

[54] DRIVE SYSTEM FOR A PRINTING APPARATUS HAVING TEXT SIZE BASED FEED SPEED CONTROL

[75] Inventors: Mathew Richard Palmer, Cambridge; Anthony Roy Dunn, Hertfordshire, both of United Kingdom

[73] Assignee: Esselte N.V., Heppenheim, Belgium

[21] Appl. No.: 778,224

[22] Filed: Jan. 8, 1997

[30] Foreign Application Priority Data

Jan. 19, 1996 [GB] United Kingdom ..... 9601124

[51] Int. Cl.[6] ..... B41J 11/42

[52] U.S. Cl. ..... 400/582; 400/120.01; 400/582; 400/583

[58] Field of Search ..... 400/279, 615.2, 400/582, 583, 120.01; 347/171

[56] References Cited

U.S. PATENT DOCUMENTS

| | | | |
|---|---|---|---|
| 5,165,806 | 11/1992 | Collins . | |
| 5,195,835 | 3/1993 | Collins . | |
| 5,217,310 | 6/1993 | Watanabe | 400/279 |
| 5,424,757 | 6/1995 | Thom . | |
| 5,458,423 | 10/1995 | Sims et al. . | |
| 5,649,775 | 7/1997 | Sakuragi et al. | 400/615.2 |

FOREIGN PATENT DOCUMENTS

| | | |
|---|---|---|
| 0 487 312 A1 | 5/1992 | European Pat. Off. . |
| 0 487 312 B1 | 5/1992 | European Pat. Off. . |
| 0 573 187 A1 | 12/1993 | European Pat. Off. . |
| 0 652 111 A2 | 5/1995 | European Pat. Off. . |
| 41 13 229 A1 | 10/1991 | Germany . |
| 63-188059 A | 1/1987 | Japan . |
| 0 592 198 A2 | 4/1994 | United Kingdom . |

*Primary Examiner*—John S. Hilten
*Attorney, Agent, or Firm*—Pennie & Edmonds LLP

[57] ABSTRACT

The present invention relates to a label printing method and apparatus which includes a housing providing a zone for receiving printing tape on which an image is to be printed, a data input device for inputting information defining the image to be printed as a label, a printing mechanism including a group of printing elements to which pixel data defining the image to be printed is passed sequentially on a group-by-group basis by a printhead controller and a motor operable to drive the printing tape past the printing mechanism.

20 Claims, 4 Drawing Sheets

DRIVE SYSTEM FOR A PRINTING APPARATUS HAVING TEXT SIZE BASED FEED SPEED CONTROL

BACKGROUND OF THE INVENTION

This invention relates to a drive system for a printing apparatus.

This invention is particularly but not exclusively concerned with the type of printing apparatus which are known as label printers. These apparatus have a housing carrying a data input device in the form of a keyboard for inputting a message to be printed and containing a printing mechanism and a drive system. The housing also includes a cassette receiving bay for receiving a cassette which houses printing tape and ink ribbon. There are several different types of this kind of label printer. Some receive a single cassette which houses at least a printing tape and an ink ribbon, as described, for example, in our earlier European Application Publication No. 0487312 and as outlined in the corresponding U.S. Pat. Nos. 5,165,806, 5,195,835 and 5,424,757. In another system, the cassette receiving bay receives two separate cassettes, one housing an ink ribbon and the other housing a printing tape. Such a system is described, for example, in our earlier European Application Publication No. 0573187 and in the corresponding U.S. Pat. No. 5,458,423. The contents of these earlier applications are incorporated herein by reference. In these and other known types of systems, the ink ribbon and printing tape are passed in overlap between a thermal printhead and a platen of the printing mechanism. For printing, the ink ribbon is pressed against the printing tape between the thermal printhead and the platen and pixel data to be printed is passed to the thermal printhead. Normally, the thermal printhead comprises a column of printing elements to which data is supplied and printed sequentially. During printing, the printing tape is driven through the printing zone defined by the thermal printhead and platen so that adjacent columns are printed sequentially in the direction of movement of the printing tape, thereby forming characters etc. to be printed.

As described in the above-referenced European Applications, the printing tape is a multilayer printing tape having an image receiving layer and a backing layer secured to the image receiving layer by an adhesive layer. The label printer includes a cutting mechanism for cutting off a portion of the multilayer tape after printing to form a label. The backing layer of the label can then be removed to allow the label to be stuck to any object.

In the printing devices discussed above, tape is driven through the printing zone by a stepper motor under the control of a microcontroller. The system relies on the assumption that, once the microcontroller has sent out the correct stepper motor drive and strobe signals in response to the reference clock, the motor and tape move as expected while ink is deposited on the printing tape at the thermal printhead. However, circumstances can arise where the tape can jam as a result of high friction levels at the platen, or elsewhere, such as in the gear train. In that case, the motor will cease to step and adjacent columns of pixels will be printed overlapping one another, resulting in a useless label.

Moreover, a stepper motor is a relatively expensive component of label printers and has a relatively high power requirement. This is particularly disadvantageous where the label printer is to be operated on batteries.

EP 0652111, in the name of Esselte Dymo N. V., discloses a label printer in which tape is driven through the printing device using a dc motor in place of a stepper motor. A dc motor is a cheaper component but can nevertheless result in equivalent print quality without the problems discussed above associated with a stepper motor. In EP 0652111, the speed of the dc motor is set to be a certain value and an encoder is used to measure the speed of the motor and to control printing of columns to adjust the time between dots in order that the spacing of printed columns on the tape remains the same.

Label printers of the type outlined above can now operate with printing tape of a plurality of different widths. For example, a proposal for a new machine can operate with tape widths of 6 mm, 9 mm, 12 mm and 19 mm. Clearly, tapes of different widths can accommodate text of different heights.

SUMMARY OF THE INVENTION

According to the present invention in one aspect there is provided a label printing apparatus comprising: a housing providing a zone for receiving printing tape on which an image is to be printed; a data input device for inputting information defining said image to be printed as a label wherein said image can be defined to include text of selectively different heights over one or more lines spaced widthwise of the printing tape; a printing mechanism including a group of printing elements to which pixel data defining the image to be printed is passed sequentially on a group-by-group basis by a printhead controller, said groups to be printed adjacent one another in the direction of movement of the printing tape; a motor operable to drive said printing tape past the printing mechanism; wherein the label printing apparatus includes means for determining a maximum height of text to be printed based on the selected height of text and the number of lines, and means for selecting a nominal speed of rotation of the motor in dependence on the determined maximum height of the text.

According to the present invention in another aspect there is provided a label printing apparatus comprising: a housing providing a zone for receiving printing tape on which an image is to be printed, said printing tape being of one of a plurality of different widths for accommodating text of different heights; a printing mechanism including a thermal printhead having a group of printing elements to which pixel data defining the image to be printed is passed sequentially on a group-by-group basis by a printhead controller, said groups to be printed adjacent one another in the direction of movement of the printing tape; and a drive system comprising: a motor operable to drive said printing tape past the printing mechanism; and means for selecting a nominal speed of rotation of the motor in dependence on the width of the printing tape and height of the text to be printed thereon.

The motor can be a dc motor or a stepper motor. A dc motor is preferred for continuously driving the printing tape past the printing mechanism.

Tapes of different widths can accommodate text of different heights, the height being measured in the direction of width of the tape. Large height text takes more power to print than text of smaller heights, and thus requires a slower tape speed. Where a motor only has one speed for all tape widths, this must be set at the speed required to allow printing of text of the greatest possible height. In the absence of the above defined aspect of the invention therefore this would mean that text of smaller heights fitting onto narrower widths of tape would be printed unnecessarily slowly. The above aspect of the invention allows the benefit of higher speed printing for smaller text heights to be utilized while not compromising the print quality of larger text heights on wider tapes. Moreover, where text of a small height is to be printed onto a wide tape, the label printing apparatus allows use of the higher speed even though a wide tape has been inserted.

Preferably, the label printing apparatus includes a data input device for inputting information defining an image to be printed and processing means for generating pixel data defining the image. The data input device could be part of the housing which includes the printing mechanism or could be arranged remotely from that housing, with pixel data being downloaded from the data input device to the label printing apparatus. The processing means can include means for determining the width of printing tape which has been inserted into the label printing device and means for calculating the height of the image to be printed thereby to determine the nominal speed of rotation of the motor to be chosen by the selecting means.

In the described embodiment, the zone for receiving printing tape is a cassette receiving bay for receiving a cassette holding printing tape. That cassette can also hold image transfer ribbon. Alternatively, the image transfer ribbon can be held in a separate cassette or can be dispensed with altogether if the labels are to be printed using a direct thermal technique.

Preferably, the label printing apparatus includes a cutting mechanism for cutting off printed portions of the tape to define a label. While it would be possible to modify the nominal speed during printing of a label, it is simpler if, when a label has been formulated, the speed of the rotation of the motor is selected for printing that label in its entirety.

The label printing apparatus can be further simplified by providing two nominal speeds for the motor, fast and slow. The determination of text height can then be made to determine merely whether the text height is large or small and the nominal speed can be selected accordingly.

Selection of the nominal speed of the motor based on text height allows a label to be printed efficiently yet with a good quality text. Moreover, it is not necessary to calculate how many printing elements will be activated for each column of print since the nominal speed of the motor is selected on the basis of the overall height of the text to be printed, regardless of whether or not that text is dense or sparse.

The present invention may be used to advantage in a label printing apparatus where the motor is used in combination with means for monitoring the speed of rotation of the motor which is connected to the printhead controller to control the sequential printing of said groups of pixel data in dependence on the speed of rotation of the motor.

The dc motor preferably causes a platen to rotate which moves the printing tape through friction. The platen cooperates with the thermal printhead for printing the image.

In the preferred embodiment, the speed monitoring means takes the form of a shaft encoder, for example comprising a slotted disc arranged to rotate with a shaft of the dc motor and a light source and a light detector on opposed sides of the disc. The printhead controller uses signals from the shaft encoder to control the sequential printing of the groups of pixel data to ensure that adjacent groups of pixel data are printed in the correct relationship which depends on the speed of the printing tape.

In another aspect there is provided a method of printing a label in a label printing apparatus which comprises a housing and providing a zone for receiving a printing tape on which an image is to be printed said printing tape being of one of a plurality of widths, the method comprising: inputting information defining the image to be printed; determining the height of said image; detecting the width of the tape; driving a motor to rotate to drive the printing tape past a printing mechanism which includes a thermal printhead having a group of printing elements to which pixel data defining the image to be printed is passed sequentially on a group-by-group basis by a printhead controller; selecting a nominal speed of rotation of the motor in dependence on said height and said width; and controlling the sequential printing of groups of pixel data so that said groups are printed adjacent one another in a direction of movement of the printing tape.

An alternative method of printing a label comprises: inputting information defining a label image to be printed on a printing tape including text of selectively different heights over one or more lines in the direction of width of a printing tape; determining the maximum height of text to be printed in said label image on said tape based on the selected height of text and the number of lines; controlling a motor to drive the printing tape past a printing mechanism which includes a thermal printhead having a group of printing elements to which pixel data defining the image to be printed is passed sequentially on a group-by-group basis by a printhead controller; selecting a nominal speed of rotation of the motor in dependence on said maximum height of text; and controlling the sequential printing of groups of pixel data so that the groups are printed adjacent one another in a direction of movement of the printing tape. Preferably, the nominal speed of rotation is maintained for the entire label image.

When the drive system is used in a printing apparatus which receives a tape cassette in which the printing tape is wound on a bobbin, the drive system can be used to provide an end-of-tape indication. If the end of the printing tape is secured to the bobbin so that it is prevented from moving, the stop can be detected by the speed monitoring means and an indication given accordingly of an end of tape state. The cassette can then be replaced by a fresh cassette. This principle can also be used to detect other fault conditions such as jamming or breaking of tape.

The means for resisting movement at the end of the tape can be implemented by securing the tape to the supply reel at its end. High friction material could additionally be provided at the end of the tape so that it slows down the platen and motor once the tape motion has stopped.

DESCRIPTION OF THE PREFERRED DRAWINGS

For a better understanding of the present invention and to show how the same may be carried into effect, reference will now be made by way of example to the accompanying drawings in which.

DESCRIPTION OF THE PREFERRED EMBODIMENTS

Figure 1:
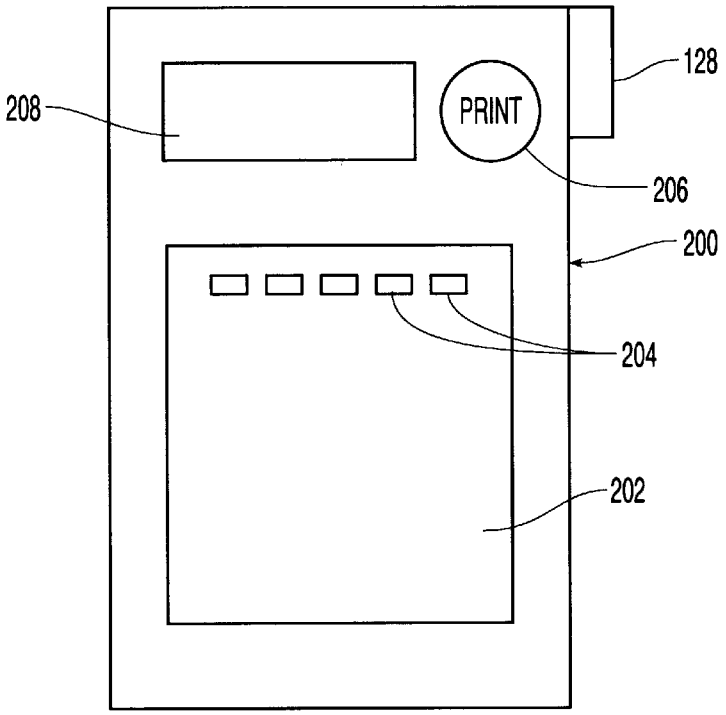
FIG. 1 is a diagram showing the front of a label printing apparatus.

FIG. 1 is a diagram of a printing apparatus of the type with which the present invention is principally concerned. The printing apparatus comprises a housing 200 which carries an input device in the form of a keyboard 202 having a plurality of keys 204. The label printing apparatus includes a print key 206 for implementing a printing operation after a label has been defined using the input device 202. The printing apparatus further has a display 208 and a cutter actuating button 128 for actuating a cutter to cut off a portion of tape on which an image has been printed to define a label.

Figure 2:
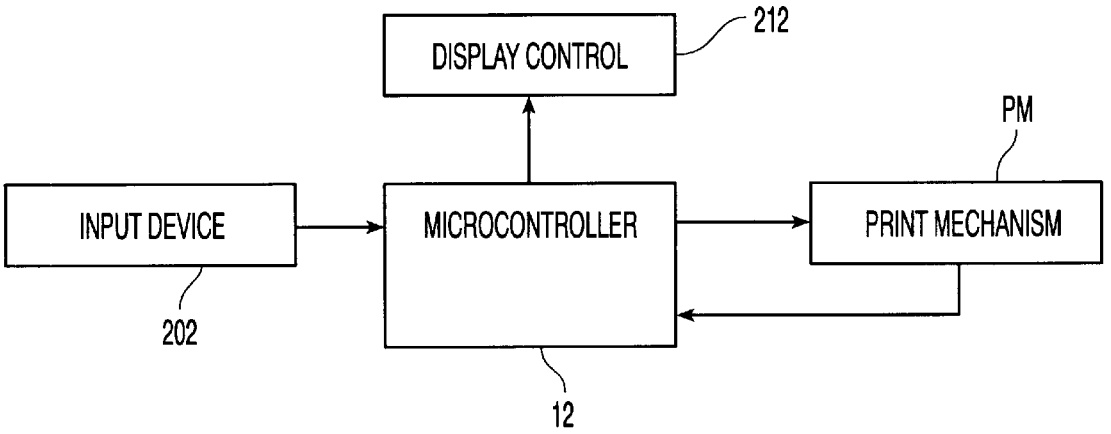
FIG. 2 is a block diagram of the principal control elements of a label printing apparatus.

As shown in FIG. 2, the input device is connected to a microcontroller 12 which controls operation of the label printing apparatus. In particular, microcontroller 12 controls the display through a display control circuit 212 and controls a print mechanism PM through a feedback loop to be described in more detail herein.

Figure 3:
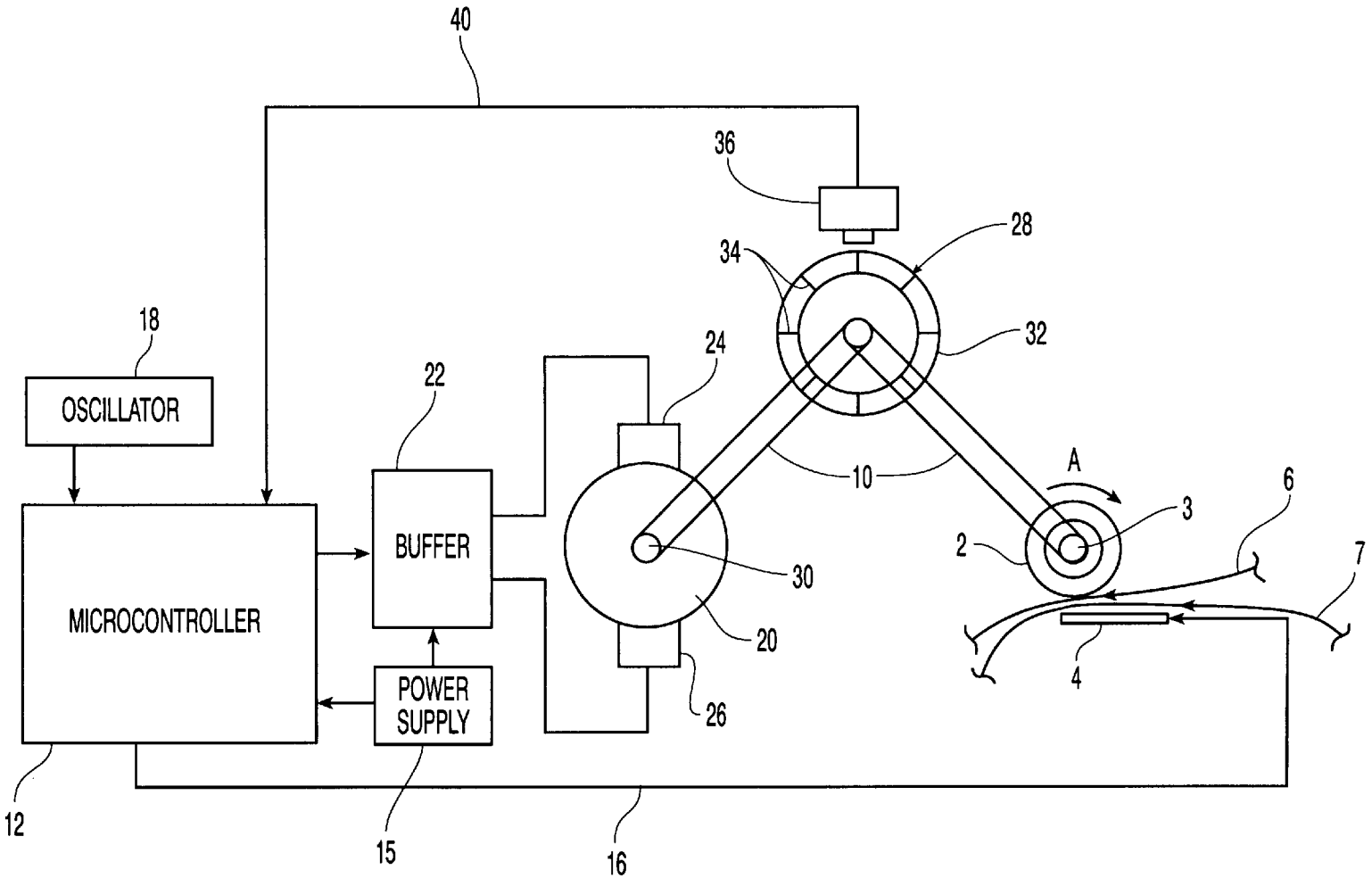
FIG. 3 is a diagram showing the elements of a drive system utilizing a dc motor.
Figure 4:
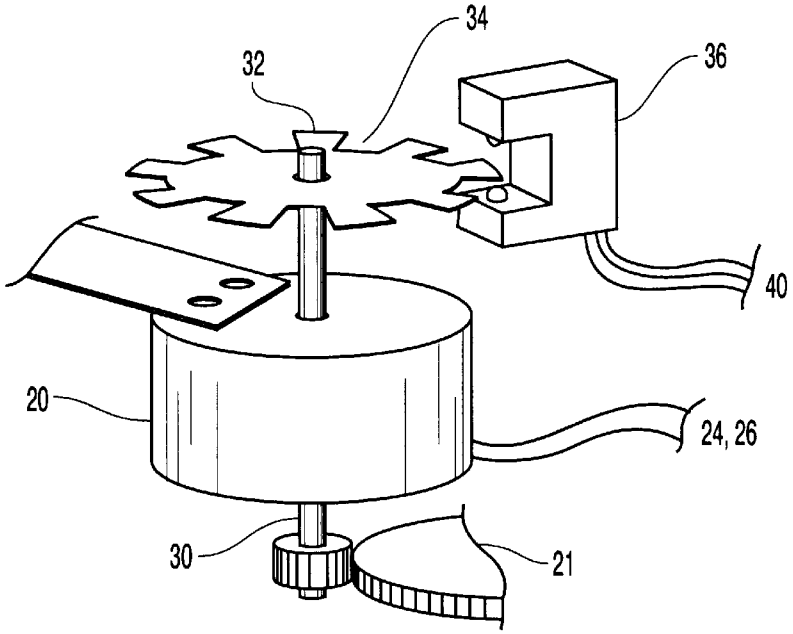
FIG. 4 is a diagram of the main elements of the shaft encoder.

FIG. 3 illustrates the elements of a drive system of a printing apparatus which include platen 2 and thermal printhead 4, respectively, as the main components of the print mechanism PM. The tape 6 and ink ribbon 7 are passed in overlap between the platen 2 and thermal printhead 4 for printing. Although not shown in FIG. 1, the ink ribbon lies adjacent the thermal printhead 4 and is wound from a supply reel to a take-up reel, normally within a cassette. In practice, the ink ribbon is driven past the printhead by the action of friction between the printing tape and the ink ribbon, the two being intended to run together at the same speed. The take-up reel is driven so that if free to do so it would pull the ink ribbon past the printhead faster than the platen would. A slipping clutch is normally provided to ensure that the ink ribbon moves at a speed defined by the platen motion, the clutch ensuring that ink ribbon slack is always taken up and tension maintained. The take-up reel can be driven with the platen to ensure that the ink ribbon is wound up, but other drive arrangements are possible. The platen is in any event driven to rotate and presses against the printing tape on one surface thereof, the other surface lying against the ink ribbon. The tape 6 is thus driven past the thermal printhead 4 by the action of friction between the tape 6 and the platen 2, which is normally made of rubber. The platen 2 is driven by a dc motor 20 through a gear train 21, as shown in FIG. 4. The motor 20 is driven from the microcontroller 12 via a current buffer 22 using pulse width modulation to approximate a linear control voltage for the dc motor 20 at its terminals 24, 26. As is well known, a dc motor rotates continuously at a speed related to the applied voltage. The rotation is continuous and not step-wise.

At the same time, data for printing is sent to the thermal printhead 4 from the microcontroller via the data line 16. The thermal printhead includes a shift register and a separate parallel storage register. Data is transferred to the printhead serially, clocked bit-by-bit under the control of the microcontroller into the shift register contained in the printhead assembly. At the end of the transfer of a column of pixel data, the data is latched into the storage register under command from the microcontroller. The storage register will hold this data until the next latching operation of new shift register contents into the storage register. Later, the printhead is "strobed" by the microcontroller to turn on high current output drivers in parallel which deposit melted ink from the ink ribbon onto the tape 6 in pixel patterns according to data held in the storage register. Clocking of data into the shift register can be occurring while a strobe signal causes printing of the data in the storage register. Although such operation is preferred, it is not necessary that the operation occurs in this way, since the operations are essentially independent. As explained above, the thermal printhead has a column of printing element which are printed as a vertical line on the printing tape. A character is thus printed by printing a number of adjacent and slightly overlapping columns containing different pixel data on the printing tape as it moves past the thermal printhead.

A shaft encoder which is indicated diagrammatically by reference numeral 28 is connected to the motor shaft 30 for monitoring the speed of the motor. The shaft encoder comprises a slotted disc 32, for example, with nine slots 34, attached to the motor shaft, with a fixed optical sensor 36 comprising an infrared light emitting diode (LED) and phototransistor which senses the passage of radiation from the LED to the phototransistor through the slots 34 of the slotted disc 32. The optical sensor 36 supplies pulses to the microcontroller 12 via a feedback line 40, each pulse indicating the passage of one slot 34 of the slotted disc 32 past the optical sensor 36. Thus, the microcontroller 12 can determine the speed of the motor 20 by measuring the frequency of the pulses fed back to it along line 40 from the optical sensor 36. The elements of the shaft encoder are shown in more detail in FIG. 4, where reference numeral 21 denotes a gear train for driving the platen from the motor.

A crystal or ceramic oscillator 18 provides reference clock cycles for the microcontroller 12. Also, the microcontroller 12 supplies print data along line 16 to the thermal printhead 4. On each print strobe signal, the column of data held in the storage register is printed. In FIG. 3, reference numeral 15 denotes a power supply for the current buffer 22 and the microcontroller 12. The power supply can be power mains or batteries.

Figure 5:
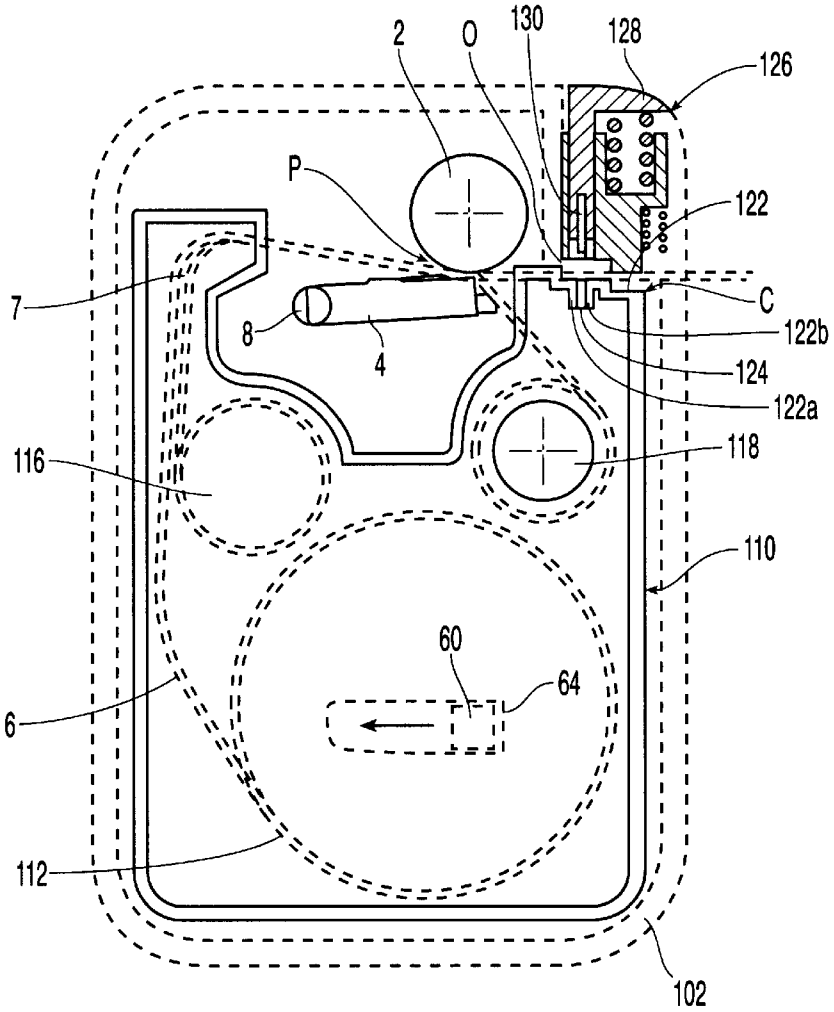
FIG. 5 is a diagram of a cassette receiving bay of a printer with a cassette therein.

FIG. 5 illustrates in plan view a cassette bay of a printing device, which is located at the rear of the device illustrated in FIG. 1. The cassette bay is shown by the dotted line 102. The cassette bay includes the thermal printhead 4 and a platen 2 which cooperate to define a print location P as described above. The printhead 4 is pivotable about a pivot point 8 so that it can be brought into contact with the platen 2 for printing and moved away from the platen to enable a cassette to be removed and replaced.

A cassette inserted into the cassette bay 102 is denoted generally by reference numeral 110. The cassette holds a supply spool 112 of image receiving tape 6 which comprises an image receiving layer secured to a backing layer by a layer of adhesive. The image receiving tape 6 is guided by a guide mechanism (which is not shown) through the cassette, out of the cassette through an outlet 0, past the print location P to a cutting location C. The cassette 110 also has an ink ribbon supply spool 116 and an ink ribbon take up spool 118. The ink ribbon 7 is guided from the ink ribbon supply spool 116 through the print location P and taken up on the ink ribbon take up spool 118.

As explained above, the platen 2 is driven so that it rotates to drive the image receiving tape 6 past the print location P during printing. In this way, tape is printed and fed out from the print location P to the cutting location C. The cutting location C is provided at a location on a portion of the wall of the cassette 110 which is close to the print location P. As the tape is fed out of the cassette by driving the platen 2, there is no need for further feed mechanism for the tape and this enables the cutting location C to be closer to the print location P. A slot 124 is defined in the wall portion 122 and the image receiving tape 6 is fed past the 30 print location P to the cutting location C where it is supported by facing wall portions 122*a*, 122*b* on either side of the slot 24.

The printing device includes a cutting mechanism denoted generally by reference numeral 126. This cutting mechanism includes the cutter actuator 128 which carries a blade 130. The blade 130 cuts the image receiving tape 6 and then enters the slot 124.

The cassette 110 can be selected from a set of cassettes, each holding a printing tape of a different width. For example, widths of 6 mm, 9 mm, 12 mm and 19 mm may be made available. The tape width which has been inserted into the printing device is identified by a tape size switch 60 which is located at the base of the cassette receiving bay and which is shown in dotted lines in FIG. 3. The tape size switch 60 can move between its location shown in FIG. 3 at the right hand side to a selected one of two additional locations, one in the center and one to the left hand side. The boundary of movement of the tape size switch 60 is illustrated by the dotted line 64. Movement of the switch 60 is detected by the microcontroller 12 to determine what width of tape has been inserted into the device. As an alternative, an automated tape width detection scheme could be provided for use with the present invention. In the preferred embodiment of the printing device, three sizes of text can be selected, denoted small, medium and large. In addition, bar codes can be printed. These can be used in relation to the selected width of tape as follows:

6 mm tape can accommodate only one line of text of small size;

9 mm and 12 mm tape can accommodate up to two lines of text of small size or one line of text of medium size; or 19 mm tape can accommodate up to four lines of text of small size, two lines of text of medium size or one line of text of large size or a bar code.

The nominal speed of the dc motor is set according to the width of tape which has been inserted and the height of text selected for printing. In the described embodiment, all labels on a tape of 6 mm, 9 mm or 12 mm width are printed at a first tape speed. If, however, tape of 19 mm width is inserted the speed of the motor may be the first speed or a second speed, slower than the first speed. If the text which has been selected for printing could have been fitted onto tape of a smaller width, the first, faster tape speed is selected for printing. If, however, the text which is selected for printing can only be printed onto a width of 19 mm, the second, slower tape speed is used.

The speed of the dc motor 20 is controlled by the microcontroller using a simple algorithm which measures the number of reference clock cycles from the crystal oscillator 18 between successive encoder pulses which are supplied to the microcontroller along feedback line 40. The value obtained from this measurement is used to calculate the nominal speed of the motor and this in turn is used to alter the pulse width of the pulse width modulated drive signal to the current buffer 22 to adjust the motor drive in a manner as to hold the speed constant. If the speed of the motor falls below a certain value, maximum drive is applied to the motor. If the speed exceeds another, higher value, no drive is supplied to the motor. In between these maximum and minimum values, a linear speed versus drive characteristic is applied. This results in a simple, if rather coarse, speed control of the motor. Clearly, as the microcontroller has knowledge of the approximate motor speed at all times, it can take appropriate action if the speed is outside certain limits.

The fact that there is only a somewhat coarse control of the speed of the dc motor is not a disadvantage for the reason that print strobe signals which control the printing of each column of data and the supply of the next column of data to the printhead is made responsive to the encoder pulses which are fed back to the microcontroller along line 40. For example, a data strobe signal can be produced for exactly one pulse, for every two encoder pulses or for any integral number of pulses. On each data strobe signal, a column of data stored in the storage register of the thermal printhead is printed. At the next strobe signal, the next column of data which has been transferred to the storage register from the shift register is printed. In this way, the deposition of ink on the printing tape is related exactly to the rotation of the motor and thus to the motion of the tape. Significant speed variations have a negligible effect on print quality, as the print strobe signals supplied to the printhead slow down or speed up in response to the actual speed of the motor, and thus the speed of the tape.

Figure 6:
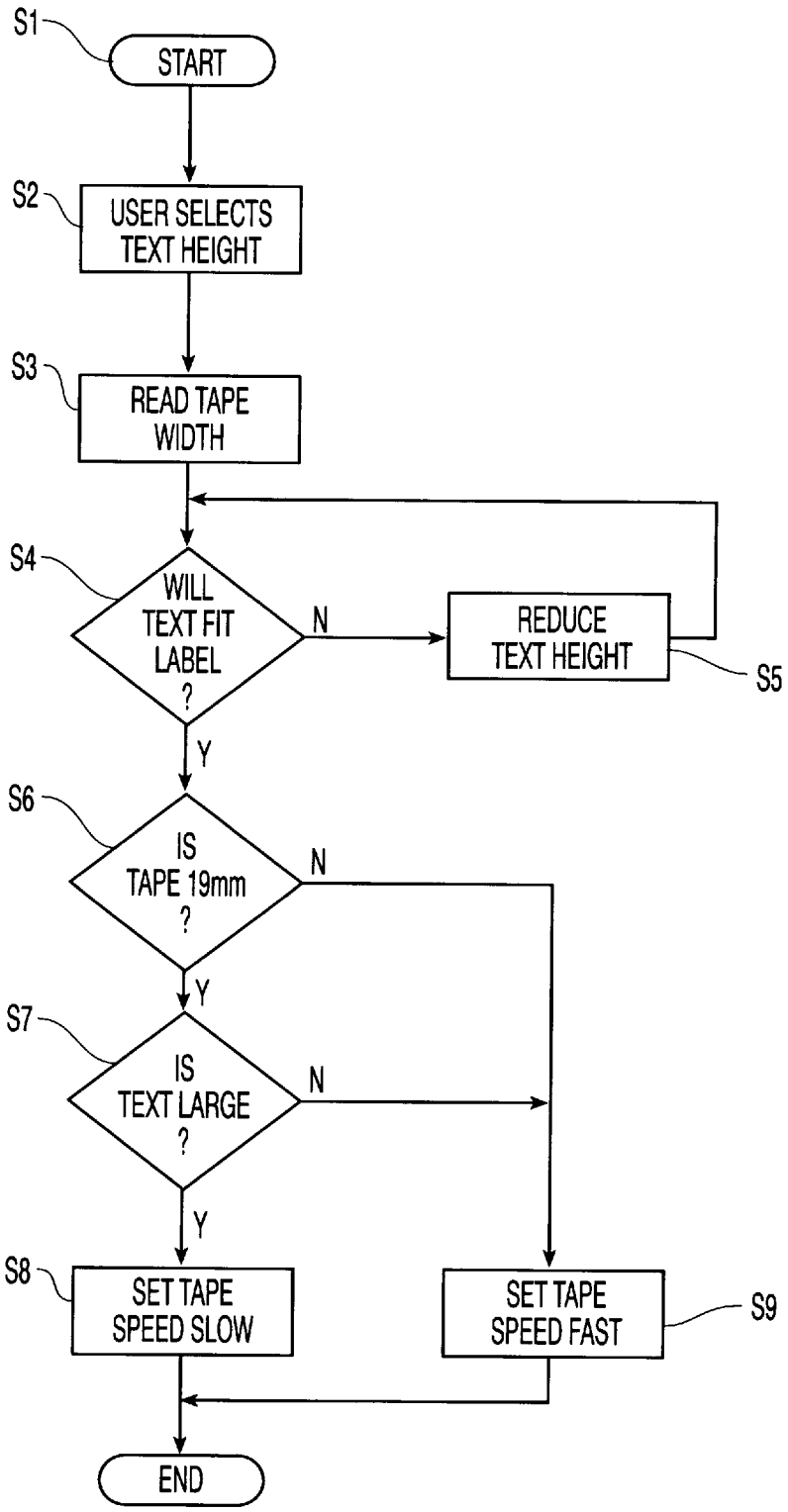
FIG. 6 is a flow diagram which illustrates the operation of the print controller.

Reference will now be made to FIG. 6 to describe in more detail how the nominal speed of the dc motor is selected in the preferred embodiment. FIG. 6 is a flow chart showing the relevant steps. The sequence starts at step S1 denoted START. At step S2 a user uses the input device 202 and its keys 204 to define a label image of selectively different text heights. The height of the printed text can be selected by a user from one of three text heights, small, medium and large, as described earlier. Moreover, the user can define that more than one line can be arranged on the tape using keys at the input device. Thus, by the end of the step S2 a user has fully defined a label image with its text height and number of lines.

At step S3 the width of the inserted tape is determined by the microcontroller. This is done in the described embodiment by detecting the position of the tape size switch. As an alternative, this could be automated. Next, a checking step S4 is carried out to determine whether the selected text height and number of lines will fit onto the width of tape which has been inserted. If it will not, the microcontroller selects a reduced height of text as indicated at S5. Following a satisfactory conclusion to the checking step S4, a further checking step S6 is carried out to see whether or not the largest width of tape (19 mm) has been inserted. An additional checking step S7 is then carried out to determine whether or not the height of the text is large. That is, if the 19 mm tape width is used, does the text fall into any of the following categories:

three or four lines of small text;

two lines of medium text;

large text; or barcode.

If the selected text falls into any of these categories, the checking step S7 is answered with a yes and a slow speed is set for the dc motor according to block S8. Alternatively, if a 19 mm tape has been inserted, but the text does not fall into any of the categories outlined above, a fast tape speed is set according to step S9. It will be clear from the flow chart of FIG. 6 that if a 19 mm tape is not utilized, a fast tape speed is selected in all circumstances.

Thus, the height of the printed text determines the tape speed, but the tape width determines the available height for the printed text. Thus, the height of the printed text is a function of the text size selected by the user and the available tape width. The described embodiment of the invention, therefore, maximizes the efficiency of printing while maintaining a good print quality for a plurality of different text heights and tape widths.

What is claimed is:

1. A label printing apparatus comprising:

a housing providing a zone for receiving printing tape on which an image is to be printed;

a data input device for inputting information defining said image to be printed as a label wherein said image can be defined to include text of selectively different heights over one or more lines spaced widthwise of the printing tape;

a printing mechanism including a group of printing elements to which pixel data defining the image to be printed is passed sequentially on a group-by-group basis by a printhead controller, said groups to be printed adjacent one another in the direction of movement of the printing tape;

a motor operable to drive said printing tape past the printing mechanism;

wherein the label printing apparatus includes means for determining a maximum height of text to be printed based on the selected height of text and the number of lines, and means for selecting a nominal speed of rotation of the motor depending upon the determined maximum height of the text.

2. A label printing apparatus according to claim 1 wherein said means for determining a maximum height of text is operable to determine whether or not the height of text is large or small, and wherein said means for selecting a nominal speed of rotation of the motor selects one of a fast speed and slow speed based on whether the maximum height of text is determined to be large or small.

3. A label printing apparatus according to claim 1 which further comprises a cutting mechanism for cutting off a portion of said printing tape printed with said image to define a label.

4. A label printing apparatus according to claim 3 wherein the selected nominal speed is maintained for the whole of said printed portion.

5. A label printing apparatus according to claim 1 wherein the zone for receiving printing tape includes a cassette receiving bay for receiving a cassette holding printing tape.

6. A label printing apparatus according to claim 5 in combination with a cassette received in said cassette receiving bay.

7. A label printing apparatus according to claim 1 wherein the motor is a dc motor and further comprising means for monitoring the speed of rotation of the motor which is connected to the printhead controller to control the sequential printing of said groups of pixel data depending upon the speed of rotation of the motor.

8. A label printing apparatus comprising:

a housing providing a zone for receiving printing tape on which an image is to be printed, said printing tape being of one of a plurality of different widths for accommodating text of different heights;

a printing mechanism including a thermal printhead having a group of printing elements to which pixel data defining the image to be printed is passed sequentially on a group-by-group basis by a printhead controller, said groups to be printed adjacent one another in the direction of movement of the printing tape; and a drive system comprising a motor operable to drive said printing tape past the printing mechanism and means for selecting a nominal speed of rotation of the motor in dependence on the width of the printing tape and height of the text to be printed thereon.

9. A label printing apparatus according to claim 8 wherein the motor is a dc motor.

10. A label printing apparatus according to claim 8 which includes a data input device for inputting information defining an image to be printed and processing means for generating pixel data defining the image.

11. A label printing apparatus according to claim 10 wherein the processing means includes means for determining the width of printing tape which has been inserted into the label printing device and means for calculating the height of the text to be printed thereby to determine the nominal speed of rotation of the motor to be chosen by the selecting means.

12. A label printing apparatus according to claim 8 wherein the means for selecting a nominal speed of rotation selects one of a fast speed and a slow speed based respectively on whether the text height is determined to be large or small.

13. A label printing apparatus according to claim 8 which comprises a cutting mechanism for cutting off printed portions of the tape to define a label.

14. A label printing apparatus according to claim 13 wherein the nominal speed of rotation of the motor is maintained for the entire printing of the printed portion.

15. A label printing apparatus according to claim 8 wherein the zone for receiving printing tape comprises a cassette receiving bay for receiving a cassette holding printing tape.

16. A label printing apparatus according to claim 15 in combination with a said cassette.

17. A method of printing a label comprising:

inputting information defining a label image to be printed on a printing tape including text of selectively different heights over one or more lines in the direction of width of a printing tape;

determining the maximum height of text of said label image to be printed on said tape based on the selected height of text and the number of lines;

controlling a motor to drive the printing tape past a printing mechanism which includes a thermal printhead having a group of printing elements to which pixel data defining the image to be printed is provided by a printhead controller;

selecting a nominal speed of rotation of the motor depending upon said maximum height of text; and controlling the printing of pixel data so that groups of pixel data are printed adjacent one another in a direction of movement of the printing tape.

18. A method according to claim 17 wherein after printing on a portion of said tape, the printed portion is cut off to define a label and wherein said nominal speed of rotation is maintained for the entire label.

19. A method of printing a label in a label printing apparatus which includes a zone for receiving a printing tape on which an image is to be printed said printing tape being of one of a plurality of widths, the method comprising:

inputting information for defining the image to be printed; determining the height of said image;

detecting the width of the tape;

driving a motor to rotate to drive the printing tape past a printing mechanism which includes a thermal printhead having a group of printing elements to which pixel data defining the image to be printed is provided by a printhead controller;

selecting a nominal speed of rotation of the motor in dependence on the height and width of the tape; and controlling the printing of pixel data so that groups of pixel data are printed adjacent one another in a direction of movement of the printing tape.

20. A method according to claim 19 wherein after printing on a portion of said tape the printed portion is cut off to define a label and wherein the nominal speed of rotation is maintained for the entire label.

* * * * *